United States Patent [19]

Owen

[11] Patent Number: 4,909,326

[45] Date of Patent: Mar. 20, 1990

[54] TUBING UNLOADER

[76] Inventor: Thomas R. Owen, 409 N. Fredonia, Longview, Tex. 75601

[21] Appl. No.: 375,614

[22] Filed: Jul. 5, 1989

[51] Int. Cl.[4] ..... E21B 34/12

[52] U.S. Cl. ..... 166/317; 166/331; 166/334; 251/347

[58] Field of Search ..... 166/330, 331, 317, 334, 166/240; 251/347

[56] References Cited

U.S. PATENT DOCUMENTS

| | | | |
|---|---|---|---|
| 1,150,661 | 8/1915 | Bushong . | |
| 1,404,874 | 1/1922 | McKissick . | |
| 1,576,597 | 3/1926 | Goss . | |
| 1,601,676 | 9/1926 | Burright . | |
| 1,639,004 | 8/1927 | Riley et al. . | |
| 1,699,052 | 1/1929 | Crowell . | |
| 1,704,383 | 3/1929 | Crowell . | |
| 1,756,499 | 4/1930 | Allen et al. . | |
| 1,810,436 | 6/1931 | Phillips . | |
| 1,972,408 | 9/1934 | Nixon . | |
| 2,053,602 | 9/1936 | Coberly . | |
| 2,270,952 | 1/1942 | Lee | 137/34 |
| 2,495,642 | 1/1950 | Penick | 166/334 X |
| 2,647,540 | 8/1953 | Page | 137/739 |
| 2,710,655 | 6/1955 | Collett | 166/115 |
| 2,720,926 | 10/1955 | Brown | 166/226 |
| 2,771,142 | 11/1956 | Sloan et al. . | |
| 2,799,350 | 7/1957 | Conrad . | |
| 2,804,829 | 9/1957 | Millins . | |
| 2,815,925 | 10/1957 | Fisher, Jr. | 251/347 |
| 2,849,025 | 8/1958 | Conrad | 137/625.48 |
| 2,858,099 | 10/1958 | Althouse, Jr. et al. | 251/347 |
| 2,874,931 | 2/1959 | Baker et al. | 251/218 |
| 2,906,493 | 9/1959 | Whitener | 251/346 |
| 2,976,932 | 3/1961 | Baker . | |
| 3,216,452 | 11/1965 | Williams | 137/614.13 |
| 3,329,213 | 7/1967 | Potts . | |
| 3,363,696 | 1/1968 | Berryman . | |
| 3,385,371 | 5/1968 | Berryman | 166/331 |
| 3,526,278 | 9/1970 | Scott | 166/152 |
| 3,532,164 | 10/1970 | Enright . | |
| 3,581,820 | 6/1971 | Burns . | |
| 3,610,337 | 10/1971 | Lewis . | |
| 3,831,677 | 8/1974 | Mullins | 166/128 |
| 3,901,333 | 8/1975 | Mori | 175/242 |
| 3,926,409 | 12/1975 | Abney et al. | 251/344 |
| 4,040,485 | 8/1977 | Vann et al. | 166/297 |
| 4,057,118 | 11/1977 | Ford | 175/215 |
| 4,103,739 | 8/1978 | Hall | 166/105 |
| 4,149,593 | 4/1979 | Gazda et al. | 166/113 |
| 4,315,542 | 2/1982 | Dockins | 166/117.7 |
| 4,333,530 | 6/1982 | Armstrong | 166/331 X |
| 4,391,326 | 7/1983 | Greenlee | 166/240 |
| 4,411,315 | 10/1983 | Baker et al. | 166/187 |
| 4,590,998 | 5/1986 | Hopper | 166/331 |
| 4,637,471 | 1/1987 | Soderberg | 166/373 |
| 4,640,363 | 2/1987 | Taylor | 166/317 |

OTHER PUBLICATIONS

"Type 'S' Hydraulic Tubing Drain", Page Oil Tools brochure.

"Page Type 'R' Mechanical Tubing Drain", Trico Industries, Inc. brochure.

"Type B Unloader 551", Arrow Oil Tools, Inc. brochure.

"Unloading Sub (671-11)", Baker Packers Retrievable Packer Systems brochure.

*Primary Examiner*—Hoang C. Dang

*Attorney, Agent, or Firm*—Pravel, Gambrell, Hewitt, Kimball & Krieger

[57] ABSTRACT

A tubing unloader including first and second housing sections adapted to be telescopingly mounted in each other and movable between open and closed positions by means of a J-slot assembly wherein an actuator pin for the J-slot includes an actuator portion which not only rides in the J-slot but also may be sheared under emergency conditions.

2 Claims, 2 Drawing Sheets

TUBING UNLOADER

TECHNICAL FIELD OF INVENTION

This invention relates to the production of oil wells and in particular to a tool allowing the safe and efficient removal of a production string.

BACKGROUND OF THE INVENTION

In the field of oil and gas well production, oil wells having low formation pressures require the use of some type of downhole pump located in the production zone for the purpose of actually pumping the oil through production tubing to the surface. One type of downhole pump is driven by a mechanical rod known as a sucker rod which connects from a surface pump drive unit known as a "pump jack" through the production tubing into mechanical connection with the downhole pump. In the use of such sucker rod pump mechanisms for actuating submersible pumps of this type, a known problem is clogging due to sand or other particle accumulation downhole in the pump. Such clogging often requires that the pump be pulled, repaired and cleaned from time to time. In order to do that, it is necessary to remove the production tubing.

Typically, at the time that submersible pump stops operating, the production tubing is "wet" in that it is filled with oil. Removal of the tubing containing the oil is undesirable for several reasons. First of all, the tubing containing the oil is extremely heavy and thus requires very heavy surface equipment to move. Secondly, it is unsafe to remove the tubing in view of possible oil spillage all over the production equipment at the surface since of course, under certain conditions, the spilled oil may be flammable.

One solution is to remove the oil from the production tubing by perforating the production tubing. Perforation requires a workover rig and equipment to actually place an explosive charge downhole in the production tubing in order to burst through the tubing to allow for drainage of the oil. The use of a workover rig as well as the perforation equipment is extremely expensive and takes additional down time. Various tools have been developed to drain or unload the oil prior to removal of the production tubing and the submersible pump. In some types of tubing drains, the actuation is hydraulic and requires the application of extremely high pressure through the production tubing in order to open plugged holes in a hydraulic type of tubing drain. Such hydraulically actuated tubing drains are undesirable because they also may require a workover rig and extremely high pressure pumps. This again adds expense and may cause additional down time.

Mechanically actuated tubing drains are also known. A myriad of different mechanical actuations have been provided for tools which include some type of attempt to unload a string.

SUMMARY OF THE INVENTION

The tubing unloader of this invention provides a new, simple and improved way to drain a "wet" tubing string when the tubing is plugged due to a clogged pump, standing valve or whatever other problem may require the downhole pump to be pulled from the well.

The tubing unloader of this invention basically includes a first, outer, cylindrical housing section which is adapted to be attached on its box or female end to the upper portion of a tubing string. A second, inner housing section or mandrel is mounted for mechanical actuation with the outer housing and includes a male or pin end portion adapted to be attached to the lower portion of the production string, which connects to the submersible pump to be pulled. The mechanical actuation between the inner and outer housing is provided by an efficient J-slot arrangement. For purposes of keeping the J-slot as clean as possible, the J-slot is located on the outer portion of the inner housing and is operated through engagement with pins which are mounted on the outer housing and extend inwardly into the J-slot. These pins are designed such that they may be sheared under emergency conditions so that the inner and outer housing may actually be totally separated under the application of sufficient shear forces such as under emergency conditions. The inner and outer housings are movable between open and closed positions. In the closed positions, a series of circumferentially positioned ports located in the outer housing are sealed off such that oil may be pumped through the production string without leakage into the annular area between the production string and the casing. Whenever it is necessary to mechanically actuate the tubing unloader utilizing the J-slot mechanism, the outer housing is moved vertically and circumferentially through manipulation of the J-slot mechanism in order to separate the outer housings to expose the drain openings to allow the oil in the production tubing to be drained prior to removal of the tubing and the clogged submersible pump or other problem piece of equipment.

This description of the invention is intended as a summary only. More details and features of the invention will now be described in the preferred embodiment. It should be understood that the claims represent the actual scope of subject matter for which patent protection is sought.

DESCRIPTION OF THE PREFERRED EMBODIMENT

Figure 1:
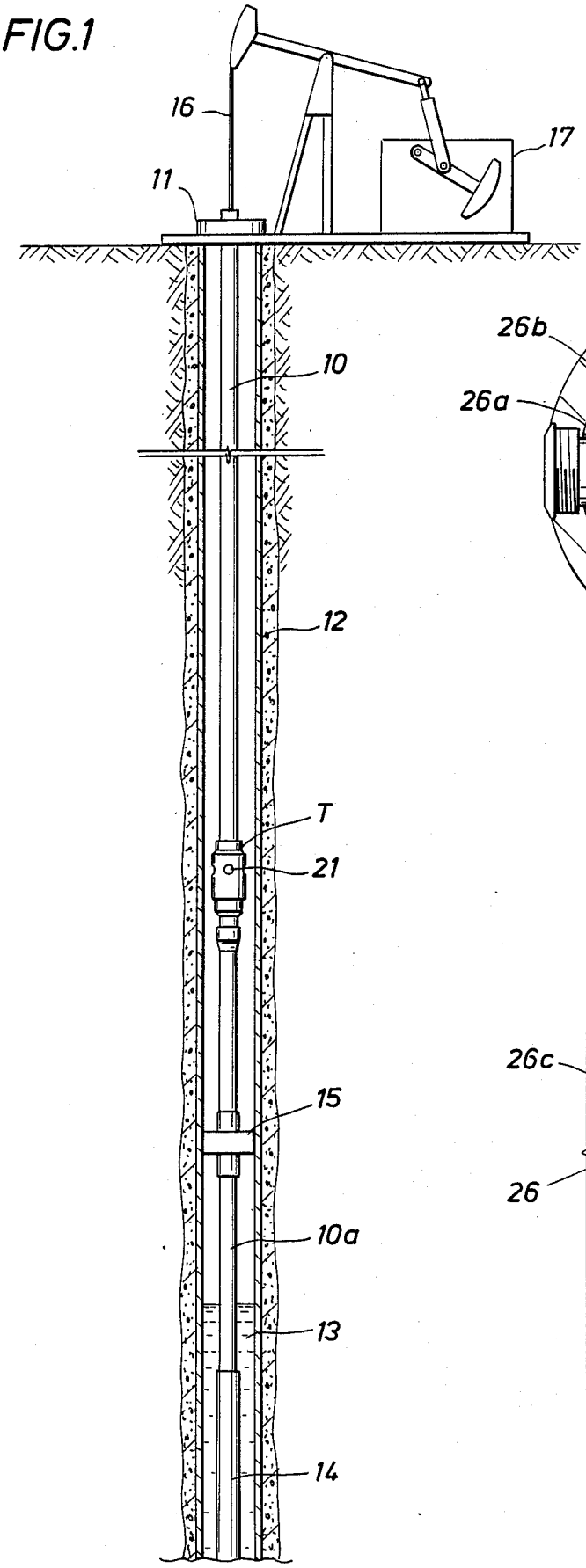
FIG. 1 is a schematic diagram illustrating the tubing unloader of this invention in position in a producing oil well.

Referring to the drawings, the letter T generally designates the tubing unloader of the preferred embodiment of this invention. In FIG. 1, the tubing unloader T is illustrated schematically in position in an oil well having low formation pressure. In such an oil well, the production string 10 extends from its surface connection 11 downwardly through the casing 12 to the production zone generally designated as 13. A submersible pump 14 is positioned within the production formation or zone 13 in order to pump the oil through the production string 10 to surface collection equipment, not shown. Typically, the tubing unloader T is located in the tubing string one or two joints above the packer or anchor 15. Another one or more joints of the production tubing, identified as 10*a*, extend downwardly from the packer or tubing anchor 15 into connection with the submersible pump 14. The submersible pump 14 is driven by a sucker rod 16 which extends downwardly all the way through the production tubing into mechanical connection with the submersible pump 14 in a known manner. The sucker rod 16 is driven through a vertical cycle by a mechanical arrangement 17 known in the oil field as a horse head or pump jack.

The tubing unloader T is generally mounted one or more joints of production tubing above the tubing anchor or packer 15 and submersible pump 14. Whenever it is necessary to remove the string of production tubing 10, a workover rig of a type known in the art is used to pull the production string 10 out of the bore hole defined by the casing 12. Prior to removal of the production string 10, it is desirable to unload any remaining oil from the tubing string T in order to reduce the weight of the tubing string and prevent any accidental spillage at the surface. The tubing unloader T of this invention allows the tubing unloader to be moved to an open, released position in which oil can be drained out of the production string by simply turning and lifting the tubing string. Thereafter, to return to normal operation, the operator need only rotate the tubing string in the other direction to cause the tubing unloader to close.

Referring now the detailed drawings of FIGS. 2–5, the tubing unloader T includes an upper, outer housing generally designated as 20 which has mounted inside thereof an inner housing or mandrel 25. The inner housing 20 and outer housing 25 are releasably connected together by J-slot assemblies generally designated as 30 provided for the purpose of moving the inner and outer housings 20 and 25, respectively, between closed and opened positions in response to rotation and vertical movement of the production tubing 10.

The outer housing 20 is a generally cylindrical member having an internal bore generally defined as 21 which may be aligned with the bore extending through production tubing to allow the flow of oil upwardly to the surface.

Figure 2:
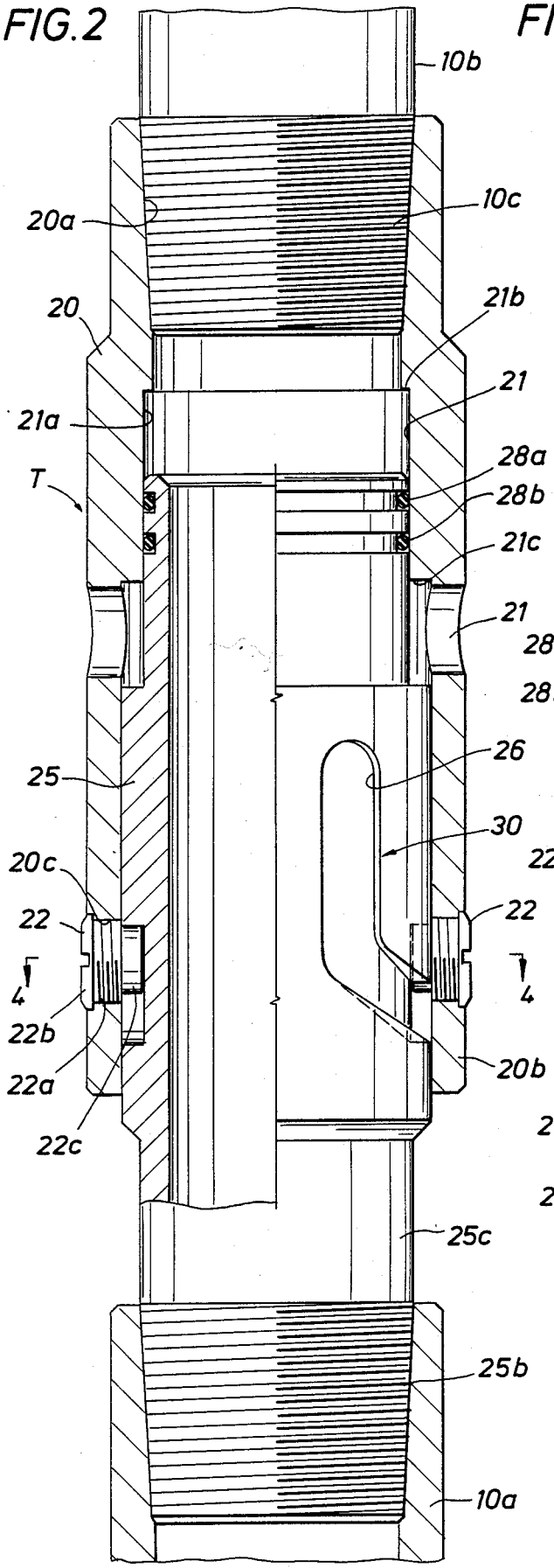
FIG. 2 is a cross-sectional view of the tubing unloader of this invention in the closed, sealed operating position.
Figure 3:
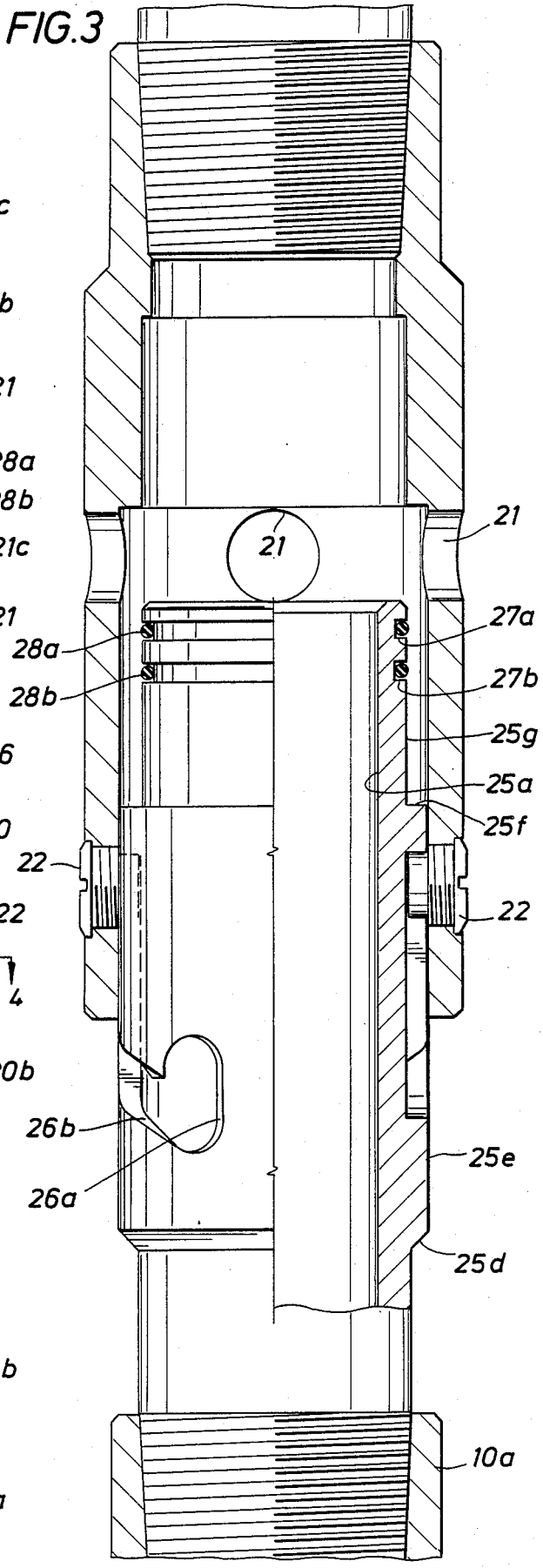
FIG. 3 is a cross-sectional view of the tubing unloader of this invention in the open, draining position.

Referring in particular to FIGS. 2 and 3, the lower end 10*b* of a joint of production tubing is illustrated with its pin end 10*c* in threaded engagement with the female, box threaded upper end 20*a* of the housing 20. The outer housing 20 further includes a series of four port holes 21 circumferentially positioned at 90° intervals about the circumference of the outer housing 20 in order to allow for drainage of oil out of the tubing string. The internal bore 21 of the outer housing 20 incudes a sealing section 21*a* formed of a generally cylindrical smooth wall and terminating in an annular shoulder 21*b*. This internal cylindrical wall which defines the sealing section 21*a* terminates at annular shoulder 21*c* in proximity to the four circumferentially spaced drain holes 21. The shoulder 21*c* can also act as a stop against inward vertical movement of the inner housing 25.

Two inwardly extending pins 22 are positioned diagonally across each other in the lower portion 20*b* of the outer housing 20. Each pin 22 is mounted in a threaded opening 20*c* in the outer housing 20, which threaded openings are, of course, positioned diagonally from each other. Each pin 22 includes a first threaded portion 22*a* which terminates in a screw head 22*b* so that the pins may be easily inserted and removed. Each pin 22 further includes an actuating portion 22*c* which has a diameter less than a diameter of the threaded portion 22*a*. The actuating portion 22*c* is designed of a certain cross-sectional area, depending upon the nature of the steel or other metal used, to shear at predesignated levels of induced shear stress. Below the predesignated levels of stress, the actuator portion 22*c* of each pin 22 is designed to ride in and serve as part of the J-slot assembly generally designated as 30 in order to allow the inner housing 20 and outer housing 25 to be moved between closed and open positions.

The inner housing 25 is also generally cylindrical in configuration and includes a smooth-walled internal bore 25*a*. The outer surface of the inner housing 25 terminates in a male or pin threaded end 25*b* which enters into a threaded connection with the female or box end of a lower production tubing joint. The lower portion 25*c* of the inner housing joins through shoulder 25*d* to a thicker, intermediate housing portion 25*e* having a larger outer diameter than the lower portion 25*b*. The intermediate portion 25*e* terminates in an upwardly facing shoulder 25*f* which is annular in configuration and joins the intermediate portion 25*e* to an upper inner housing portion 25*g*.

Figure 4:
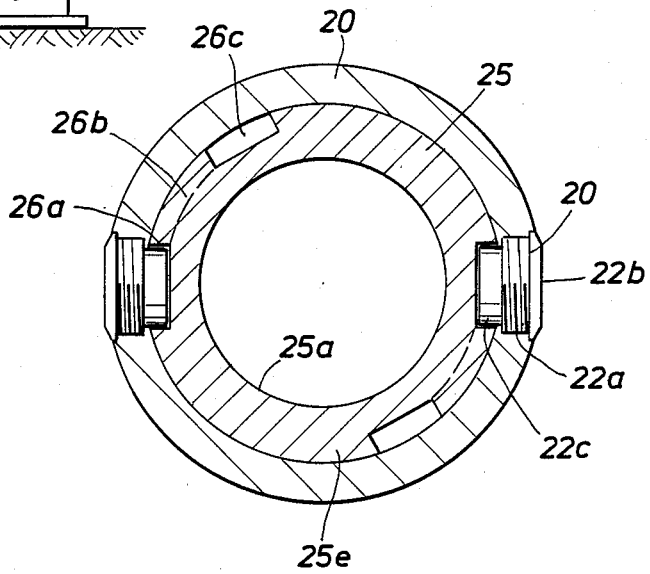
FIG. 4 is a sectional view taken along line 4—4 of FIG. 2 and illustrates the shearable pins in position in the J-slot.
Figure 5:
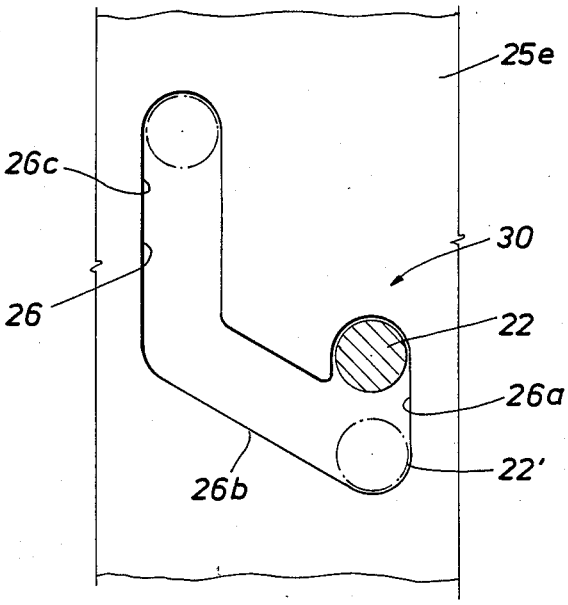
FIG. 5 is a schematic view of one of the J-slots located on the outer portion of the mandrel and illustrates the position of one of the shearable pins in the normal position of FIG. 2 and in the released position of FIG. 3.

The intermediate inner housing portion 25*e* is illustrated in FIGS. 4 and 5 as well as in FIGS. 2 and 3. The intermediate housing portion 25*e* includes two, diagonally oppose J-slot arrangements generally designated as 26 which cooperate with the inwardly extending pins 22 to provide a vertically movable and rotatable, releasable connection between the outer housing 20 and the inner housing 25.

Referring to FIG. 5, where the J-slot 26 is illustrated schematically, the J-slot 26 includes a first vertical groove portion 26*a*, a second, inclined portion 26*b* and a third, vertical portion 26*c* which provides for a greater vertical travel than the first vertical portion 26*a*. Each of the three portions 26*a–c* of the J-slot 26 is adapted to receive the inwardly extending pins 22 and provide for relative movement between the inner housing 25 and the outer housing 20 as will be hereinafter described.

The upper portion 25*g* of the inner housing 25 is of a reduced diameter as compared to the intermediate housing portion 25*e*. The upper housing portion 25*a* is formed of a cylindrical outer wall member having two vertically spaced grooves 27*a* and 27*b* machined therein in order to receive O-ring seals 28*a* and 28*b*, respectively. The outside diameter of the upper inner housing portion 25*g* is machined to a tolerance and dimension slightly less than the internal diameter of the outer housing internal seal section 21*a* so as to receive the upper housing portion 25*g* therein for vertical movement. The O-ring seals 28*a* and 28*b* are positioned to sealably engage against the inner bore sealing section 21*a* of the outer housing in order to prevent the passage of fluid, including oil contained in the production string during normal pumping operations.

Operation and Use

In operation and use, the tubing unloader T provides an easy means of draining the tubing string when the tubing string is plugged because of a fouled pump, standing valve or for other reasons. The tubing unloader T is run in the production tubing string 10 one or two joints above the anchor or packer 15. The tubing unloader T can be opened and closed without pulling the tubing string out of the hole. Utilizing a workover rig or other string manipulation rig, the production string is manipulated to move vertically downward such that the pins 22 in the vertical portion 26*a* of the J-slot 26 is moved downwardly to the dotted position 22' illustrated in FIG. 5. Then, the productions string is rotated such that the pins 22 ride along the inclined slot portions 26*b* in the stationary inner housing 25 until the pins are positioned in the longer vertical slot portions 26*c*. The production tubing is then further raised to allow the inner housing member 25 and outer housing member 20 to be moved vertically away from each other from the closed position of FIG. 2 to the open position of FIG. 3. In the open position of FIG. 3, the upper sealing portion 25*g* of the inner housing 25 is moved out of the internal sealing section 21*a* of the bore 21 of the outer housing 20 thereby exposing the four openings 21 such that any oil in the production tubing may be drained outwardly. Whenever it is desirable to close the tubing unloader T, the manipulation of the J-slot is reversed and the outer housing member 20 is moved to the sealed position with respect to the inner housing member 25 as illustrated in FIG. 2.

The tubing unloader T is not affected by pressure or tubing weight. The utilization of pins 22 with shearable portions 22*c* riding in the J-slots allows for a complete separation of the inner and outer housings in case of emergencies. Of course, the pins are designed such that shear will only occur under desired emergency level conditions such as, for example, allowing for shear at 80,000 pounds vertical tension.

The advantages of this simple, safe and efficient tubing unloader are many. There is no down time waiting for a pump truck or a wire line truck in order to drain the tubing string. Furthermore, the cost of repair of this tool is minimal. Additionally, the tubing unloader T may be used over and over again and even moved from one well to another with minimal repair. Additionally, no type of hydraulic pressure is needed to actuate the tubing unloader of this invention.

The foregoing disclosure and description of the invention are illustrative and explanatory thereof, and various changes in the size, shape and materials, as well as in the details of the illustrated construction may be made without departing from the spirit of the invention.

For example, the tubing unloader T would also be useful to inject chemicals into a production string or aid in cleaning paraffin, wax or other deposits from the interior of the tubing string. Thus the tubing unloader provides a safe and efficient means for circulating fluid from the production tubing outwardly into the annulus without operating the submersible pump 14 in order to clean the system.

I claim:

1. A new and improved tubing unloader, comprising:

an outer housing of a generally cylindrical structure, said outer housing including a central bore and having an upper, threaded portion adapted to threadedly engage the production string;

said outer housing including a plurality of drain ports positioned in horizontal alignment and being circumferentially spaced;

said outer housing including means for mounting inwardly extending pins, each of said inwardly extending pins being threadedly mounted in said outer housing and including an internally extending, actuator portion;

an inner housing including a lower portion, an intermediate portion and an upper portion;

said lower portion being adapted to be connected to the production string;

said intermediate portion including J-slots which align with and receive the actuating portions of said pins mounted in said outer housing;

said inner housing upper portion including means for slideably, sealably engaging the internal bore of said outer housing; and said actuating portions of said pins extending inwardly from said inner housing being designed to shear at certain emergency levels to allow for complete separation of said inner and outer housings such that the production string may be pulled.

2. The structure set forth in claim 1, including:

said inner bore of said outer housing including a cylindrical, sealing section which receives said upper portion of said inner housing; and first and second O-rings mounted on said upper portion of said inner housing such that a redundant O-ring seal is provided for sealing in the event of failure of the first O-ring seal.

* * * * *